United States Patent [19]

Izraeli

[11] Patent Number: 4,550,965

[45] Date of Patent: Nov. 5, 1985

[54] CONNECTOR ASSEMBLY FOR INSULATED CABLE

[75] Inventor: Hyman Izraeli, West Caldwell, N.J.

[73] Assignee: Thomas & Betts Corporation, Raritan, N.J.

[21] Appl. No.: 488,305

[22] Filed: Apr. 25, 1983

[51] Int. Cl.[4] ..... H01R 4/24; H01R 4/44

[52] U.S. Cl. ..... 339/47 R; 339/97 R; 339/99 R; 339/113 R; 339/116 C; 339/246

[58] Field of Search ..... 174/78; 339/14 R, 47 R, 339/47 C, 49 R, 94 R, 94 M, 96, 97 R, 97 P, 99 R, 113 R, 114, 115 R, 115 C, 116 R, 116 C, 117 R, 246

[56] References Cited

U.S. PATENT DOCUMENTS

| | | | |
|---|---|---|---|
| 1,489,835 | 4/1924 | Kietz | 339/246 |
| 1,991,669 | 2/1935 | Hausman | 339/246 |
| 2,052,081 | 8/1936 | Campbell | 339/115 R |
| 2,673,968 | 3/1954 | Smith | 339/99 R |
| 3,012,091 | 12/1961 | Schiffmann | 174/94 |
| 3,115,541 | 12/1963 | Hanner et al. | 339/97 P |
| 3,117,829 | 1/1964 | Leach | 339/97 P |
| 3,248,684 | 4/1966 | Hubbard et al. | 339/95 |
| 3,761,867 | 9/1973 | Churla | 339/98 |
| 3,808,353 | 4/1974 | Burtelson | 174/78 X |
| 3,848,956 | 11/1974 | Kraft | 339/223 |
| 4,293,176 | 10/1981 | Lindlöf | 339/98 |
| 4,310,209 | 1/1982 | Fleming et al. | 339/246 |
| 4,410,226 | 10/1983 | Adduci et al. | 339/116 R X |

FOREIGN PATENT DOCUMENTS

| | | | |
|---|---|---|---|
| 0017048 | 3/1980 | European Pat. Off. | 339/98 |
| 1924964 | 12/1970 | Fed. Rep. of Germany | 339/98 |
| 2318502 | 10/1973 | Fed. Rep. of Germany | 339/246 |
| 2508594 | 9/1976 | Fed. Rep. of Germany | 339/98 |
| WO80/01506 | 7/1980 | PCT Int'l Appl. | 339/246 |

OTHER PUBLICATIONS

Lane and Young, (AMP Incorporated), Shield Bonding Terminal for Buried Service Wire, 1982.

*Primary Examiner*—Gil Weidenfeld
*Assistant Examiner*—Steven C. Bishop
*Attorney, Agent, or Firm*—Robert M. Rodrick; Salvatore J. Abbruzzese

[57] ABSTRACT

A cable connector assembly for sealably connecting the conductive sheath of an insulated cable. The connector assembly comprises a conductive member having insulation piercing contacts. The conductive member includes a spring element which is formed to provide a predetermined force by the contact on the cable. The assembly further includes a sealing enclosure for accommodating the conductive member and sealing the connection.

8 Claims, 8 Drawing Figures

FIG. 3
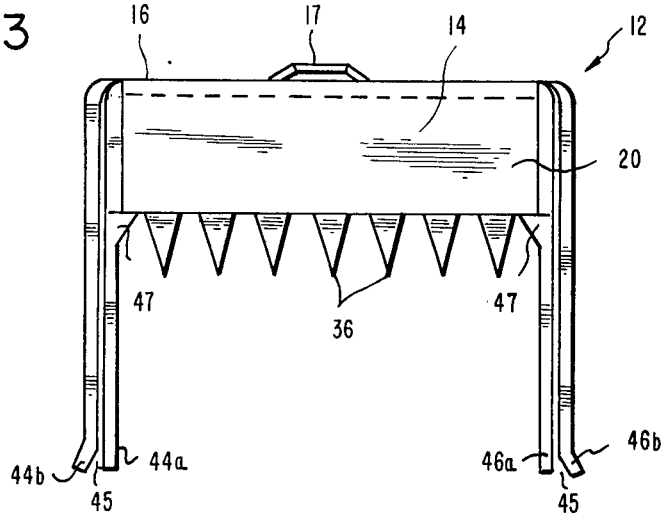
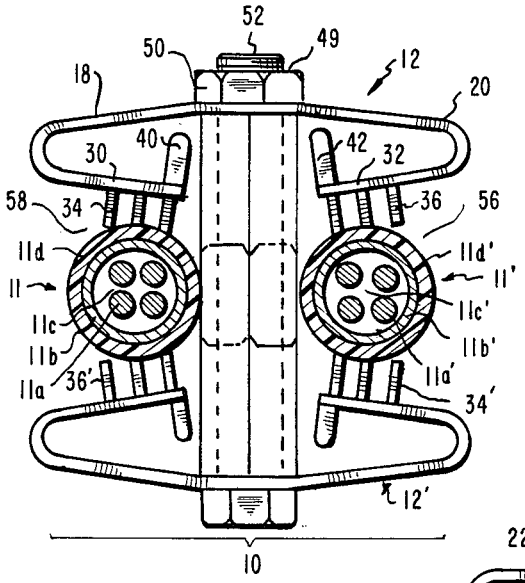
FIG. 4
FIG. 5
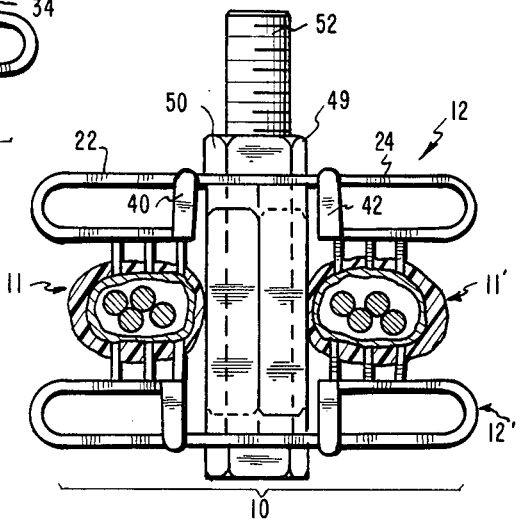

CONNECTOR ASSEMBLY FOR INSULATED CABLE

FIELD OF THE INVENTION

This invention relates generally to an electrical connector for insulated, metallic shielded cable and more particularly relates to an insulation displacing connector for establishing ground continuity between connected cables.

BACKGROUND OF THE INVENTION

In connecting transmission cables of the type buried underground, and referred to as direct burial cables, an installer is usually faced with the problem of trying to connect cable of various construction. Typically, these cables contain a plurality of insulated conductors surrounded by an insulated thermoplastic sheet and a metallic conductive sheath which may or may not be itself insulated. An outer insulative jacket usually surrounds the entire cable structure. In various applications, these cables may vary as to the size and number of conductors, composition and construction of the metallic sheath and thickness of the outer jacket. Furthermore, most cables of this type often include a material core which fills the void between the conductors inside the conductive sheath. This core may range from a core constructed of a solid insulative material to one of relatively viscous petroleum gel which is injected between conductors. It is apparent that due to these construction variations, each type of cable will be subject to different degrees of deformation both upon interconnection and long term creep. It is not uncommon for many of the cable structures to deform from a normally circular cross-section to one that is more elliptical or flattened.

The actual interconnection of the signal carrying conductors of two or more cables is accomplished in one of a number of well-known methods. However, in addition to connecting these signal-carrying conductors, the conductive ground sheaths must also be connected to insure ground continuity between the cables.

The art has seen a number of interconnection techniques for connecting the ground sheath of two direct burial transmission cables. One such method employs a split bolt or nut to clamp the conductive sheath of two stripped cables. Another, described in a paper by David Lane and Bob Young entitled, "Sheath Bonding Terminal for Buried Service Wire, International Wire & Cable Symposium Proceeding" (1982), employs a clip "type" spring contact for engaging the stripped cable sheaths. In each of the prior methods, the cable would have to be previously stripped or "skinned" before the connector could be employed. Stripping a cable is both time-consuming and difficult as, in addition to stripping away the outer insulative jacket, the conductive sheat often contains a further insulative coating which is exceedingly difficult to remove. Failure to sufficiently remove the coating will result in an ineffective ground connection.

There are still other connectors known in the art employing insulation piercing techniques for piercing the insulation of a cable and contacting the conductive member. Such an insulation piercing connector is shown and described in U.S. Pat. No. 4,293,176 issued Oct. 6, 1981 to Lindlof. However, connectors of this type could not be employed with transmission cable for contacting the conductive sheath, as depth of penetration cannot be precisely regulated. Overpenetration could cause a piercing of the conductive sheath and contact with a signal-carrying conductor thereby causing a short. Conversely, underpenetration would provide ineffective ground connection. Further, as the cable may exhibit some degree of "creep" due to stresses applied to the plastic elements by the connector, the insulation displacing contacts which were initially suitably connected may become dislodged from the sheath and fail to provide a continuous and reliable ground connection.

It is therefore desirable to provide an insulation piercing cable connector which is capable of receiving a wide variety of cable constructions and where the piercing force can be precisely regulated to prevent over or under insertion. Further, the connector should be able to compensate for cable creep throughout its life.

SUMMARY OF THE INVENTION

It is an object of the present invention to provide an improved cable connector for connecting an insulated cable.

It is a more particular objectof the present invention to provide an insulation piercing contact, the extent of penetration of which can be precisely regulated.

In the efficient attainment of these and other objects, the present invention looks toward providing an electrical connector for insulated cable. The cable is supported in the connector. A movably secured conductive member includes a contact portion for engagement with the cable. The contact portion includes insulation piercing teeth thereon which engage the conductive sheath of the cable. Clamping means urge the conductive member into contact with the cable. The conductive member is formed into a spring, the selection of which regulates the force at which the insulation piercing teeth contact the conductive sheath. The force applied by the teeth to the cable is selected to be sufficient to pierce the insulation and provide a stable contact with the conductive sheath yet not penetrate through the insulative sheet which surrounds the conductors.

BRIEF DESCRIPTION OF THE DRAWING

FIGS. 1–3 show, respectively, front, bottom and side elevational views of one contact member of the connector of the present invention.

FIG. 4 shows a further elevational view of the assembled connector of the present invention supporting therein two cables shown in section, in a non-crimped position.

FIG. 5 is the connector of FIG. 4, shown in crimped position.

DETAILED DESCRIPTION OF THE PREFERRED EMBODIMENT

Figure 1:
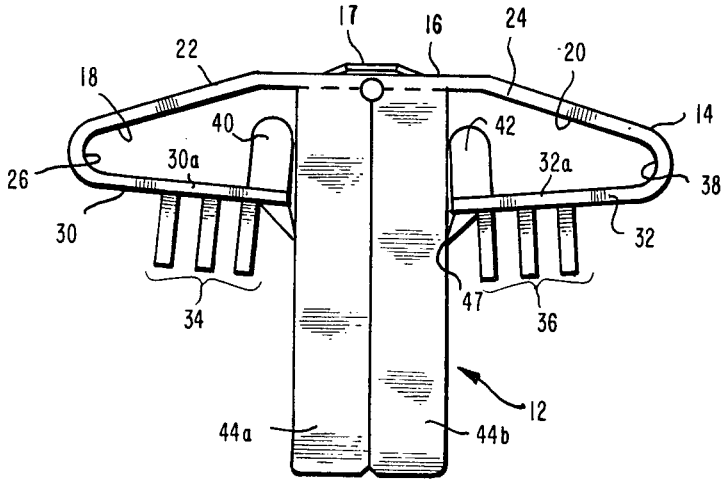

As shown in FIGS. 4 and 5, the connector 10 of the present invention comprises primarily a pair of identical, interlocking hermaphroditic contact members 12 and 12' for engaging transmission cables 11 and 11'. For simplification of description, as contact members 12 and 12' are identical in the preferred embodiment of the present invention, contact member 12 primarily will be described in detail herein. It is noted that elements bearing similar reference numerals (e.g., 12 and 12') of contact member 12' will be identical to elements of contact member 12.

Figure 2:
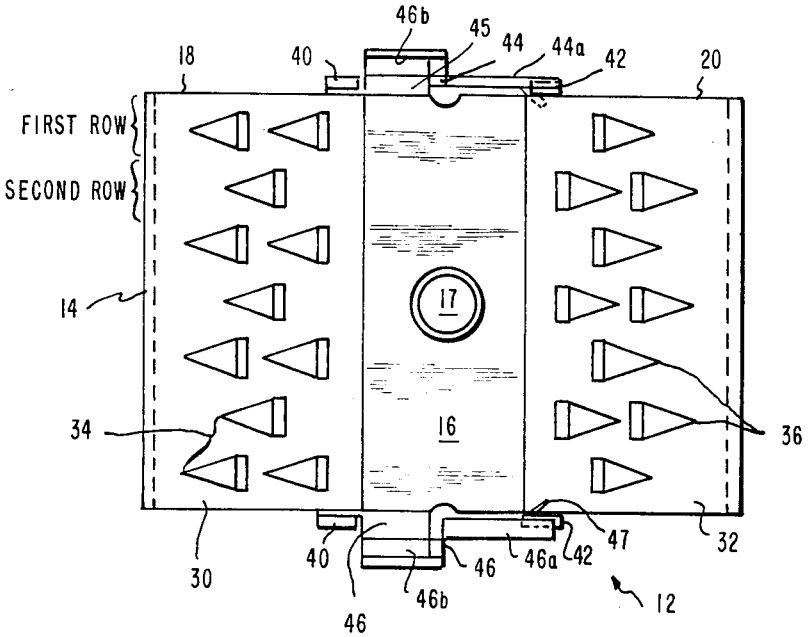

Referring to FIGS. 1–3, contact member 12 is a conductive element which is preferably constructed of steel or similar metal. Steel is chosen as a preferable material as it exhibits both sufficient conductive characteristics and also is sufficiently resilient when employed as a cantilever-type spring, as will be described hereinafter.

Contact member 12 includes an upper body extent 14 having an elongate flat central region 16. Central region 16 includes therethrough a centrally located mounting aperture 17 which receives a bolt or other fastening device for securing contact member 12 to contact member 12'. Flanking either side of central region 16 are a pair of limbs 18 and 20 which extend in a cantilevered fashion from opposite longitudinal sides of central region 16. Limbs 18 and 20 each include an upper shoulder 22 and 24 respectively, which extend downwardly and outwardly from central region 16. The distal extents of shoulders 22 and 24 from arcuate portions 26 and 28 which curve below shoulders 22 and 24 as shown in FIG. 1. A pair of arms 30 and 32 extend inwardly and downwardly from arcuate portions 26 and 28 respectively. These arms 30 and 32 underlie the outwardly extending shoulders 22 and 24. The distal extents of arms 30 and 32 (opposite arcuate portions 26 and 28) form flat contact portions **30*a* and 32*a*, which, upon interconnection, engage the cables 11 and 11'** (not shown), as will be described in detail hereinafter.

Contact portions **30*a* and 32*a* each include thereon a patterned array of insulation piercing teeth 34 and 36 which are lanced out of the flat surface thereof. Teeth 34 and 36 extend downwardly from contact portions 30*a* and 32*a* respectively, and as is shown in FIGS. 1 and 3 are substantially perpendicular thereto. In preferred form, teeth 34 and 36 are lanced out in triangular shape from the contact portions 30*a* and 32*a*, and are bent downwardly therefrom. However, any suitable insulation piercing configuration such as trapezoidal or rectangular shapes may be employed. Teeth 34 of contact portion 30*a* and teeth 36 of contact portion 32*a* are respectively positioned to form a unique pattern thereon. As shown, for example, in FIG. 2, laterally adjacent teeth are formed in a mating pattern where teeth 34 number two in the first row (uppermost row), one in the second, two in the third and so on. Teeth 36 are arranged in an opposite fashion having one tooth in the first row, two in the second and so on. As will be described hereinafter, an identical contact member 12' will be connected to contact member 12, in an opposite overlying position, so that teeth 34 of contact member 12 will overlie teeth 36' of contact member 12'**. Thus, in each row a single tooth row will be aligned with a double tooth row, so that the teeth will be staggered, having a tooth of one contact portion between two teeth of the other contact portion. This arrangement will insure proper contact with the ground sheath of the cables, and diminish the possibility of crushing the signal conductors by point-to-point contact.

As shown in FIGS. 1 and 2, contact member 12 further includes visual indication fingers 40 and 42 which extend upwardly from opposite distal edges of contact portions **30*a* and 32*a*. Fingers 40 and 42 extend outwardly of the side margin of shoulders 22 and 24, as seen in FIG. 2, so that upon compression of arm 30 toward shoulder 22, as will be described hereinafter, fingers 40 and 42 will be in non-interfering position therewith. The specific position of visual indication fingers 40 and 42 is shown only by way of example. It is contemplated that the fingers may be placed on other portions of contact member 12, as, for example, depending downwardly from shoulders 22 and 24 adjacent central region 16**.

Contact member 12 further includes a pair of legs 44 and 46 extending downwardly from opposite transverse sides of central region 16. Legs 44 and 46 support contact member 12 for mating connection with identically formed contact member 12'. Each of legs 44 and 46 comprises a pair of side-by-side leg portions. As best shown in FIGS. 1–3, legs 44, which is identical to leg 46, has a first leg portion **44*a* which is immediately adjacent central portion 16. Second leg portion 44*b* is spaced further outwardly from central portion 16 and provides a clearance 45 therebetween. This clearance 45 permits accommodation of a first leg portion 46*a'* of identically formed contact member 12'. It can be appreciated that two identical contact members 12 and 12' such as shown in FIGS. 4 and 5 can be interlocked by arranging the contact members such that leg 44 of contact member 12 will engage leg 46' of contact member 12'. Thus, leg portion 46*a'* will be accommodated in clearance 45 and leg portion 44*a* of contact member 12 will be accommodated in clearance 45' of contact member 12'. The same is true of the opposite interlocking legs 44' and 46. As leg portions 44*a* and 44*b* are supported only at one end (as are leg portions 46*a* and 46*b*), they have a tendency to deflect upon connection with contact member 12' to facilitate ready interconnection. Interlocking the contact members 12 and 12' in this manner will provide the proper orientation of the teeth as above desribed. Legs 44 and 46 each further include a substantially horizontally projecting ledge 47 which extends inwardly, as shown in FIG. 2, from first leg portion 44*a* and 46*a*. Ledge 47 extends below and adjacent the distal edge of contact portions 30 and 32** and forms a seating surface to support the contact portions in the non-crimped position.

The connector 10 further includes a clamping assembly 49 which secures contact member 12 to contact member 12'. In the preferred form and as shown in FIGS. 4 and 5, clamping assembly 49 comprises a nut 50 and bolt 52. Bolt 52 is accommodated in aperture 17 of contact member 12, for example. In this position the threaded end of bolt 52 will extend through aperture 17' of second contact member 12' connected thereto. Nut 50 is threadably secured to the end of bolt 52 and secures contact member 12 to contact member 12'.

Having described the structure of the connector 10 of the present invention, its operation is best shown with reference to FIGS. 4 and 5.

Contact member 12 is slideably inserted into contact member 12' with legs 44 and 46 of contact member 12 being interlocked with the legs 44' and 46' of contact member 12' as above described. Bolt 52 is inserted through apertures 17 and 17' of the respective contact members, and is threadably secured to nut 50.

In this position, oppositely facing contact portions **30*a*, 32*a* and 30*a'*, *32a'* from a pair of cable receiving channels 56 and 58. Channels 56 and 58 are bounded both by the interlocked legs of the connector 10 and by the oppositely facing insulation piercing teeth. As previously mentioned, cable 11 (which is similar to cable 11' in the presently described embodiment) is a direct bural transmission cable having a plurality of insulated conductors 11***a* which are usually wrapped in a thermoplastic or extruded sheet (not shown) which is surrounded by a metallic sheath 11*b*. Sheath 11*b* is a conductive, metallic member usually formed of aluminum, copper or similar metal, and may also include an outer insulative thermoplastic coating thereover. The cable further contains a petroleum gel core 11*c* between the individual conductors 11*a* to prevent moisture propagation therethrough. The entire cable structure is enclosed by an outer insulative jacket 11*d*, usually of extruded polypropylene.

Cables 11 and 11' are inserted into the interlocked cable connector 10, having a longitudinal portion thereof seated in channels 56 and 58 between the overlying sets of insulation displacing teeth 34–36' and 36–34', respectively. The cables may be inserted laterally until they abut against the interlocked legs 44–46' and 46–44' of the connector 10. The legs provide an alignment guide, insuring proper insertion and alignment with the teeth.

With the cables 11 and 11' properly positioned in the connector 10, the ground connection between sheaths 11*b'* and 11*b* may now be accomplished. As assembled connector 10 of the present invention is symmetrical about both the major horizontal and major vertical axes. Where convenient, description will only be made to one of the two contact members 12, 12' and/or its connection to one cable 11. It is apparent that both contact members 12 and 12' will make identical simultaneous connection to both cables 11 and 11'.

The nut 50 is tightened on bolt 52. The screw tightening of bolt 50 will urge the contact members 12 and 12' progressively toward one another, thus forcing teeth 34, for example, into cable jacket 11*d*. Teeth 34 will easily penetrate the soft plastic jacket with little physical resistance thereagainst. In the description provided hereinafter, the term resistance will refer to the physical or mechanical resistance which the cable or sheath presents, rather than its electrically resistive properties. Thus, the corresponding cantilevered spring formed by limb 18 of contact member 12 will only flex slightly, if at all, during teeth penetration of jacket 11*d*. In addition, cable resistance against limb 18 will also be minimized as the cable will have a tendency to creep or flatten out upon compression due to its soft inner core 11*c*. Once the teeth 34 have fully penetrated the jacket 11*d*, further tightening of bolt 50 will cause the teeth 34 to contact metallic conductive sheath 11*c*. Upon contact with sheath 11*c*, further penetration of the teeth 34 will be resisted by the harder surface of the metallic sheath 11*c*. This resistance will cause more severe deflection of the cantilevered limb 18 due to compression against the harder cable sheath 11*c*. This deflection of limb 18 will take two forms. The shoulder 22 will deflect upwardly (away from cable 11), while additionally, arm 30 will be compressed toward shoulder 22. Thus, arm 30 will move in relation both to the cable 11 and to the shoulder 22. Once the teeth 34 have engaged the cable sheath, further compression will cause further dual deflection of the limb 18 and, as the cantilevered spring limbs are formed in accordance with the present invention. The rate at which the teeth further penetrate into cable 11 will be decreased. There will be, however, at least a slight scoring of the surface of conductive sheath 11*c* by teeth 34 which will insure adequate electrical connection.

The present invention contemplates forming contact member 12 to have cantilevered spring limbs 18 and 20 which will deflect upon application of a controlled force which is less than the force necessary for teeth 34 to fully penetrate cable sheath 11*c*. In forming such a spring, the spring constant of the material and the shape and dimension of contact member 12 are selected to provide a spring member which will apply a force (by the teeth 34), on the cable within a predetermined range, to assure a proper electrical connection between the ground sheaths, yet will not penetrate into the signal conductor.

As shown in FIGS. 4 and 5, the contact members 12 and 12' are compressed together by the screw tightening of nut 50 and bolt 52. As above described, such compression will cause the teeth 34–36 to contact the conductive sheath 11*c* and 11*c'* of the cable. As practiced, once the teeth have engaged the sheaths, further screw tightening will result in further compression of the cantilevered springs rather than deeper penetration of the teeth due to the increased resistance of the metallic sheet. This allows the installer a wider range in which the contact members 12 and 12' can be compressed. The nut 50 and bolt 52 can be further screw tightened, within an acceptable range, without the teeth exceedingly penetrating the cable sheath; thus providing a wide range of screw-tightening in which adequate connection can be assured. In practice, the present invention provides a visual indication of the range in which reliable contact with the sheath 11*c* can be assured. As above described, the unsecured extents of arms 30 and 32 include a pair of visual indication fingers 40 and 42 which extend upwardly (toward shoulders 20 and 22). As the arms 30 and 32 are progressively compressed toward shoulders 20 and 22, due to teeth 34 and 36 contacting sheaths 11*c* and 11*c'*, the tips of the fingers 40 and 42 will clear the horizontal level of shoulders 20 and 22, as shown in FIG. 5. Once clear of this level, a proper electrical contact with sheaths 11*c* and 11*c'* will be indicated.

Additionally, spring movement of cantilevered limbs 18 and 20 and thereby proper connection to sheaths 11*c* and 11*c'* can be gauged by observing the relative movement between contact portion 30*a* and 32*a* and the respective ledge 47. Movement of contact portions 30*a* and 32*a* relative to ledge 47 will assure contact with sheath 11*c* and 11*c'*.

It is appreciated that the simplest and preferred method of gauging proper insertion is to observe the movement of shoulders 22 and 24. Upon insertion, the shoulders will move from a relatively bowed position, convex configuration shown in FIG. 4, to a flat or slightly concave position shown in FIG. 5, indicating that proper force and teeth insertion has been attained.

As limbs 18 and 20 depend from opposite sides of central portion 16, each limb acts as an independent cantilevered spring. More resistance against penetration on one side of the contact member will cause more deflection of the limb on that side. Thus, it can be appreciated that connector 10 can connect cables of varying size and construction.

Providing an illustrative example of a contact member formed in accordance with the present invention, the material chosen can be for example, 1050 spring steel. When formed to have a cantilevered portion of about 0.750" in length, and a spring rate of about 3.42 lbs. per tenthousandths of an inch.

In typical applications, cables 11 and 11' are connected by aligning them in parallel fashion, having the exposed ends thereof adjacently disposed. The extending signal carrying conductors 11*a* and 11*a'* are interconnected in a manner known in the art, and shown schematically at 83 in FIG. 8. The ground sheaths 11*c* and 11*c'* are then interconnected using the above described connector 10. As the connected cables are to be placed underground in a direct burial application, the connection is to be environmentally sealed. The present invention further contemplates providing a sealed enclosure which will accommodate the signal conductor connections, as well as the insulation piercing ground connector described above.

Figure 6:
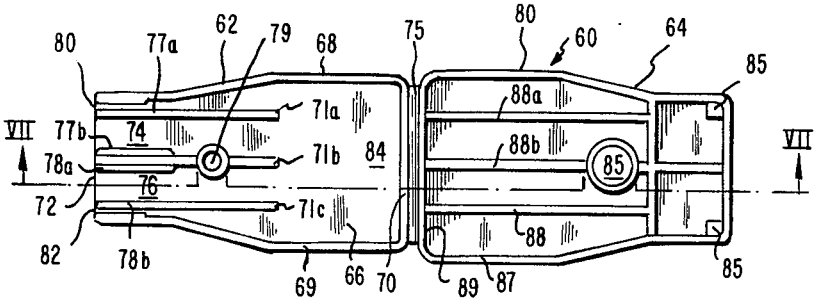
FIGS. 6 and 7 show in top elevational and side sectional views, respectively, the connector sealing enclosure of the present invention in an opened position.
Figure 7:
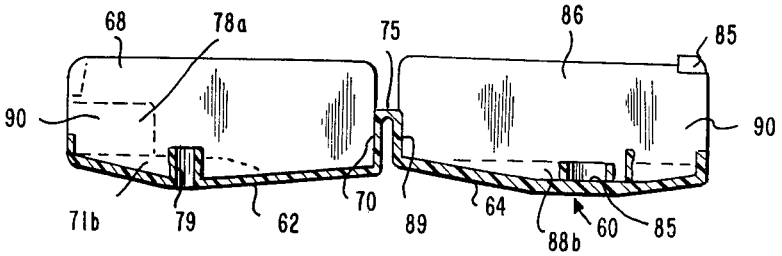

Referring now to FIGS. 6 and 7, a sealable enclosure 60 is shown. Enclosure 60 is generally a clamtype hollow member integrally formed of a suitable plastic material such as polypropylene. Enclosure 60 comprises two main members, a base shell 62 and an upper shell 64 hingedly attached thereto and engageable with the lower shell to form a substantially enclosed container.

Base shell 62 includes a substantially flat bottom 66 and is bounded by upwardly extending side walls 68 and 69 and back wall 70, side walls 68 and 69 extending substantially further upwardly than back wall 70. Additionally, a front wall 70*a* extends up from bottom 66. Base shell 62 further includes an open tapered front portion 72 which accepts the side-by-side connected cable assembly. The tapered front portion is divided into two cable receiving channels 74 and 76 by two pairs of upstanding partitions 77*a*–77*b* and 78*a*–78*b*. The outside partitions 77*a* and 78*b* are spaced inwardly from the side wwalls 68 and 66 respectively, have flat rib portions 71*a* and 71*c* thereof extending toward the rear of the base 62. Further, with side walls 68 and 69 they form therebetween a pair of side vents 80 and 82 which will be described in detail hereinafter. The inner partitions 77*b* and 78*b* have a rearwardly extending rib portion 71*b* which includes a centrally located cavity 79 which accommodates bolt 52 of the connector assembly 10. The rear portion of base shell 62 forms a connection receiving region 84 for accommodating the signal conductor connections 83.

Figure 8:
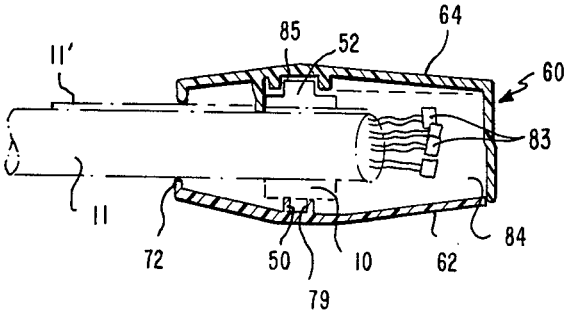
FIG. 8 shows in section the closed connector enclosure of FIG. 7 with the connector and cables, shown in phantom, inserted therein.

Upper shell 64 is attached to base shell 62 by a web of material therebetween which forms a hinge 75. Hinge 75 allows upper shell 64 to serve as a cover for enclosing base shell 62. A snap 85 or another conventional locking arrangement secures upper shell 64 in a closed position over base shell 62. As with base shell 62, upper shell 64 is bounded by side wealls 86 and 87, back wall 89 and front wall 89*a*. The dimensions of upper shell 64 are slightly greater than the corresponding dimension of base shell 62, to permit upper shell 64 to enclose base shell 62 as shown in FIG. 8. Upper shell 64 further includes three longitudinal ribs 88*a*, 88*b* and 88*c*, which correspond with the extending rib portions 71*a*–*c* of portions 77*a*–77*b* and 78*a*–78*b* of base shell 62 to further define the cable receiving channels 74 and 76. Central rib 88*b* also includes a centrally located cavity 85 which accommodates nut 50 of the connector assembly 10.

As enclosure 60 provides a moisture-proof seal around the cable connection, the upper and lower shells 62 and 64 are filled with a petroleum based gel 90 which is similar to gel 11*d* of cable 11. Gel 11*d* may be contained in either one or both of base shell 62 and upper shell 64.

As shown in FIG. 8, the connected cables 11 and 11', having conventional signal connectors 83 and ground shield connector 10 connected thereto, are inserted into the base shell 62 of the opened enclosure 60. Each of cables 11 and 11' lies in the respective cable receiving channel 74 and 76. The connector screw is inserted into cavity 79 for proper connector positioning. The signal-conductor connections 83 lie in region 84. Upon closure of upper shell 64 connector 10 is seated in the central portion of base shell 62 with nut 50 and bolt 52 being accommodated in cavities 79 and 85, respectively. As the cables 11 and 11' and connector assembly 10 have displaced some of the petroleum gel 90, this excess gel will be expelled through vent openings 80 and 82 at the front portion 72. Thus, the connection will be fully enclosed and encased in gel 90 thereby insuring a moisture-proof seal. The integrally formed enclosure 60 of the present invention allows all electrical connections to be done externally thereof. The connected assembly may then be securely seated in the enclosure, which is conveniently seated in a shell-type manner.

Various other modifications to the foregoing disclosed embodiment will be evident to those skilled in the art. Thus, the particularly described preferred embodiment is intended to be illustrative and not limited thereto. The true scope of the invention is set forth in the following claims.

I claim:

1. A connector for electrical cable having a conductive sheath surrounded by an insulative jacket, said connector comprising:

a base for supporting said cable;

a conductive member movably secured to said base, said conductive member including a support surface; a cantilevered spring supported by said support surface including a first cantilevered portion extending from said support surface of said conductive member and a second cantilevered portion extending from an unsecured end of said first cantilevered portion back toward said support surface; a contact portion on said second cantilevered portion movably supported relative to said support surface; and contact portion including an insulation piercing contact for contacting said cable upon movement of said conductive member; said cantilevered spring formed to provide a predetermined force by said insulation piercing contact on said cable upon moving said conductive member towards said base, said predetermined force being greater than the resistance of said insulative jacket and less than the resistance of said conductive sheath; and clamping means for moving said conductive member toward said base.

2. The connector in accordance with claim 1 wherein said base includes a first aperture and said conductive member includes a second aperture alignable with said first aperture; and said clamping means includes a bolt interposed through said first and second aperture, and a nut threadably attached to said bolt.

3. The connector in accordance with claim 1 wherein said conductive member further includes means for visually determining the extent of penetration of said insulation piercing contact.

4. The connector in accordance with claim 1 wherein said base includes a second conductive member having an insulation piercing contact thereon for penetrating said insulative jacket of said cable and for contacting said conductive sheath upon relative movement of said first and second conductive members.

5. A connector for electrically connecting the conductive sheath of a pair of insulated cables comprising:

a pair of oppositely facing conductive elements supported for relative movement therebetween; each of said conductive elements having a support surface and a pair of oppositely extending cantilevered springs, each of said cantilevered springs including a first cantilevered portion supported at one end by said support surface, and a second cantilevered portion supported at one end by the unsupported end of said first portion and extending toward said cable receiving region, the unsupported end of each second portion having a cable contacting portion said cable contacting portion of one of said pair of conductive element being aligned with said cable contacting portion of the other of said pair, and forming therebetween a pair of cable receiving regions for supporting said cables; said contacting portions further including insulation piercing teeth extending into said cable receiving regions for engaging said cable upon said relative movement of said pair of conductive members; said cantilevered spring selected to have a spring constant and configuration so as to provide a force by said insulation piercing teeth, upon said relative movement of said conductive members, greater than the resistance presented by the insulation of said cables and less than the resistance presented by said conductive sheaths; and means for imparting said relative movement of said pair of conductive elements.

6. The connector in accordance with claim 5 wherein each of said contact portions is movable relative to both said support surface and respective said first cantilevered portion.

7. The connector of claim 5 wherein each contact member of said pair is hermaphroditic having interlocking portions thereon for mating engagement with opposite portions of the other said contact member of said pair.

8. The connector of claim 7 wherein said interlocking portions of said contact members form an alignment surface for properly aligning said cables in said cable receiving regions.

* * * * *